United States Patent [19]

Muzslay

[11] Patent Number: 4,806,105

[45] Date of Patent: Feb. 21, 1989

[54] STACKING CONNECTOR

[75] Inventor: Steven Z. Muzslay, Huntington Beach, Calif.

[73] Assignee: ITT Corporation, New York, N.Y.

[21] Appl. No.: 142,601

[22] Filed: Jan. 11, 1988

[51] Int. Cl.[4] ..... H01R 9/09

[52] U.S. Cl. ..... 439/74; 439/81; 439/883

[58] Field of Search ..... 439/44, 74, 75, 78, 439/65, 81, 327, 328, 367, 596, 603, 144, 786, 830, 832, 883

[56] References Cited

U.S. PATENT DOCUMENTS

| | | | |
|---|---|---|---|
| 2,701,346 | 2/1955 | Powell | 339/17 |
| 3,466,591 | 9/1969 | Ecclesia | 339/17 |
| 3,492,538 | 1/1970 | Fergusson | 317/101 |
| 3,539,965 | 11/1970 | Morehart et al. | 439/81 |
| 3,806,767 | 4/1974 | Lehrfeld | 339/176 |
| 3,827,005 | 7/1974 | Friend | 339/258 |
| 4,245,876 | 1/1981 | Ritchie et al. | 339/59 |
| 4,345,806 | 8/1982 | McHenney | 339/19 |
| 4,521,065 | 6/1985 | Nestor et al. | 339/75 |
| 4,555,151 | 11/1985 | Neese et al. | 339/17 |
| 4,629,267 | 12/1986 | Stepan | 339/17 |
| 4,631,637 | 12/1986 | Romania et al. | 439/74 |

*Primary Examiner*—Gil Weidenfeld
*Assistant Examiner*—P. Austin Bradley
*Attorney, Agent, or Firm*—Thomas L. Peterson

[57] ABSTRACT

A stacking connector is disclosed for connecting the conductive traces on a pair of printed circuit boards. A row of conductive pins are mounted on each of the boards, with each pin connected to one of the conductive traces on the board and aligned with a pin on the other board. The stacking connector includes a plurality of double ended tuning fork contacts, one for each set of aligned pins on the two boards. The tuning fork contacts embody detent recesses which cooperate with the pins to provide a mechanical latching of the contacts, as well as an electrical connection, to the pins on the boards.

24 Claims, 2 Drawing Sheets

FIG. 1
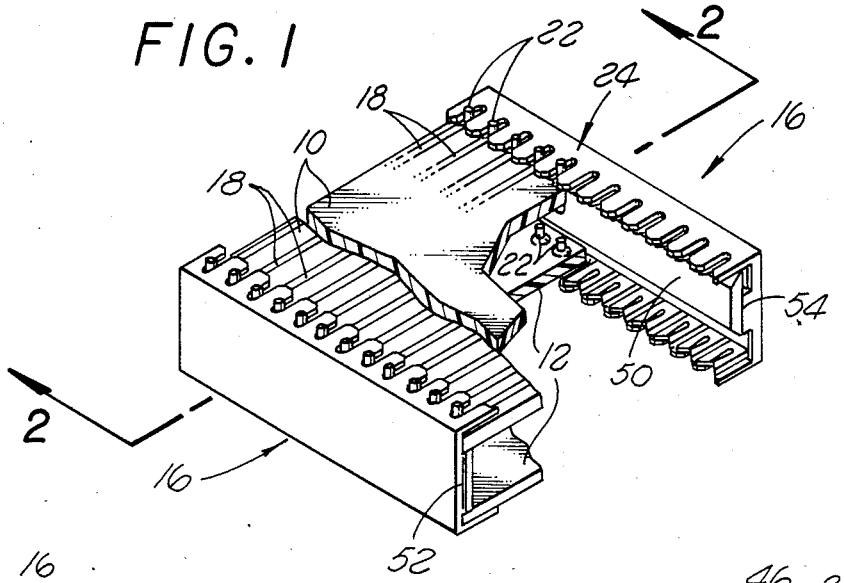
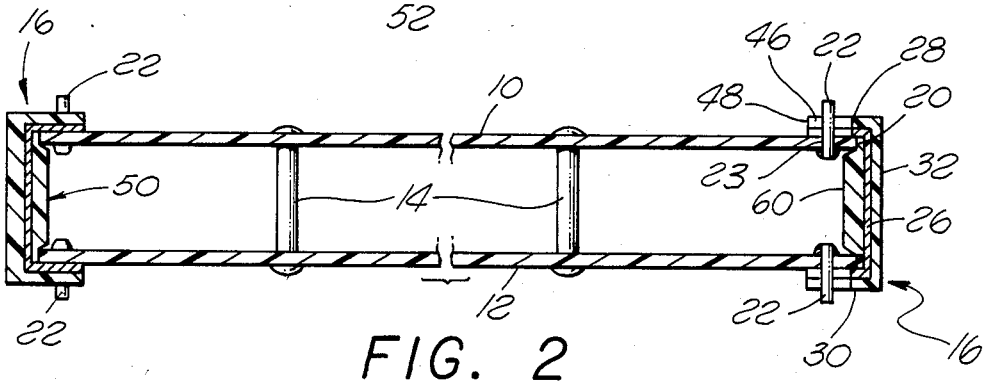
FIG. 2
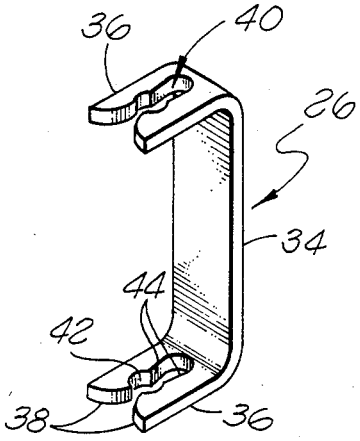
FIG. 4
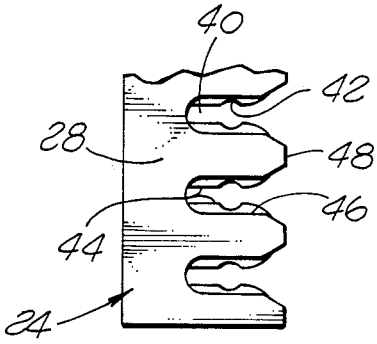
FIG. 5

STACKING CONNECTOR

BACKGROUND OF THE INVENTION

The present invention relates generally to an electrical connector and, more particularly, to a stacking connector for interconnecting traces on a pair of stacked, vertically spaced printed circuit boards.

It is often desireable to electrically interconnect the conductive traces extending to the edges of stacked, vertically spaced printed circuit boards. A stacking or laminated connector may be used for this purpose. Typically the contacts of the connector are formed with multiple bends, providing two generally U-shaped upper and lower sections joined by an intermediate section. The upper section of each contact is frictionally engaged over the edge of the upper board, while the lower U-shaped section of the contact is frictionally engaged over the edge of the lower board. The contacts of the connector are spaced apart a distance corresponding to the spacing of the conductive traces on the boards so that the contacts will make electrical engagement with corresponding conductive traces on the upper and lower boards. An example of such a connector is disclosed in U.S. Pat. No. 4,245,876. If the assembly is subject to substantial vibration, it is possible that the contacts of the stacking connector will become misaligned with the conductive traces on the spaced printed circuit boards, sometimes resulting in a contact bridging adjacent traces on the boards, which is undesireable. In order to avoid this problem, it is necessary to provide in the prior art stacking connector some arrangement for assuring that the contacts are held in alignment with the pairs of conductive traces on the boards, and that the connector is locked to the boards in such a manner as to retain the alignment between the contacts and the traces. Such alignment and locking means adds to the cost of the assembly.

U.S. Pat. No. 4,521,065 discloses a printed circuit board connector, somewhat similar to a stacking connector, for connecting the traces on a pair of boards. Multi-bent contacts are mounted in the housing of the connector, each having U-shaped end sections for receiving the edges of the boards. The contacts provide electrical connection between corresponding conductive traces on the boards. In this connector, the printed circuit boards are mounted in slots in the connector housing of predetermined length and position relative to the contacts to assure alignment between the contacts and the traces on the boards. Further, the printed circuit board embodies latching arms which engage against latch shoulders on the connector housing to lock the two parts together.

It is the object of the present invention to provide an improved stacking connector for a pair of spaced printed circuit boards which is relatively simple in structure, inexpensive, and does not require additional alignment and locking hardware between the connector and the boards to assure that the contacts are properly aligned with the traces on the boards, and that the connector is retained latched to the boards.

SUMMARY OF THE INVENTION

According to a principal aspect of the present invention, there is provided a stacking connector comprising an insulator having a plurality of spaced contacts mounted thereon. Each contact is a double ended tuning fork-type contact, with the tuning fork end portions of the contact bent generally perpendicular to a vertically extending central port ion of the contact. Rows of conductive pins are mounted on the printed circuit boards. The pins are electrically connected to the conductive traces on the boards. The spacing of the pins on the boards corresponds to the spacing of the contacts in the connector. Further, each pin on one board is aligned with a corresponding pin in the other board. When the connector is mounted over the edges of the printed circuit boards where the pins are located, the pins will slidably receive the tuning fork end portions of the contacts to make electrical connection therebetween. In addition, a detent recess is formed in the inner edge of at least one of the contact beams of each tuning fork end portion of the contacts which receives the corresponding pin on a printed circuit board to thereby lock the contacts and, hence, the connector onto the pins. Thus, the electrical contacts of the connector, together with the conductive pins on the printed circuit boards, provide the means for making both electrical and mechanical connection between the connector and the conductive traces on the boards. Accordingly, the present invention overcomes the problem of possible misalignments between the contacts and the traces on the boards inherent in the prior art stacking connectors, and avoids the need for having separate latch elements on the insulator of the connector to make a locking connection to the printed circuit boards.

Other objects, aspects and advantages of the invention will become apparent from the following description taken in connection with the accompanying drawings.

DESCRIPTION OF THE DRAWINGS BRIEF

FIG. 1 is a perspective view of a pair of printed circuit boards having stacking connectors of the present invention mounted on its opposite ends, with portions of the boards broken away to show the interior structure of one of the connectors;

FIG. 2 is a vertical sectional view taken along line 2—2 of FIG. 1;

FIG. 4 is a perspective view of one of the contacts used in the connector of the present invention; and FIG. 5 is a fragmentary top view showing one end of the connector illustrated in FIG. 3.

DESCRIPTION OF THE PREFERRED EMBODIMENTS

Figure 3:
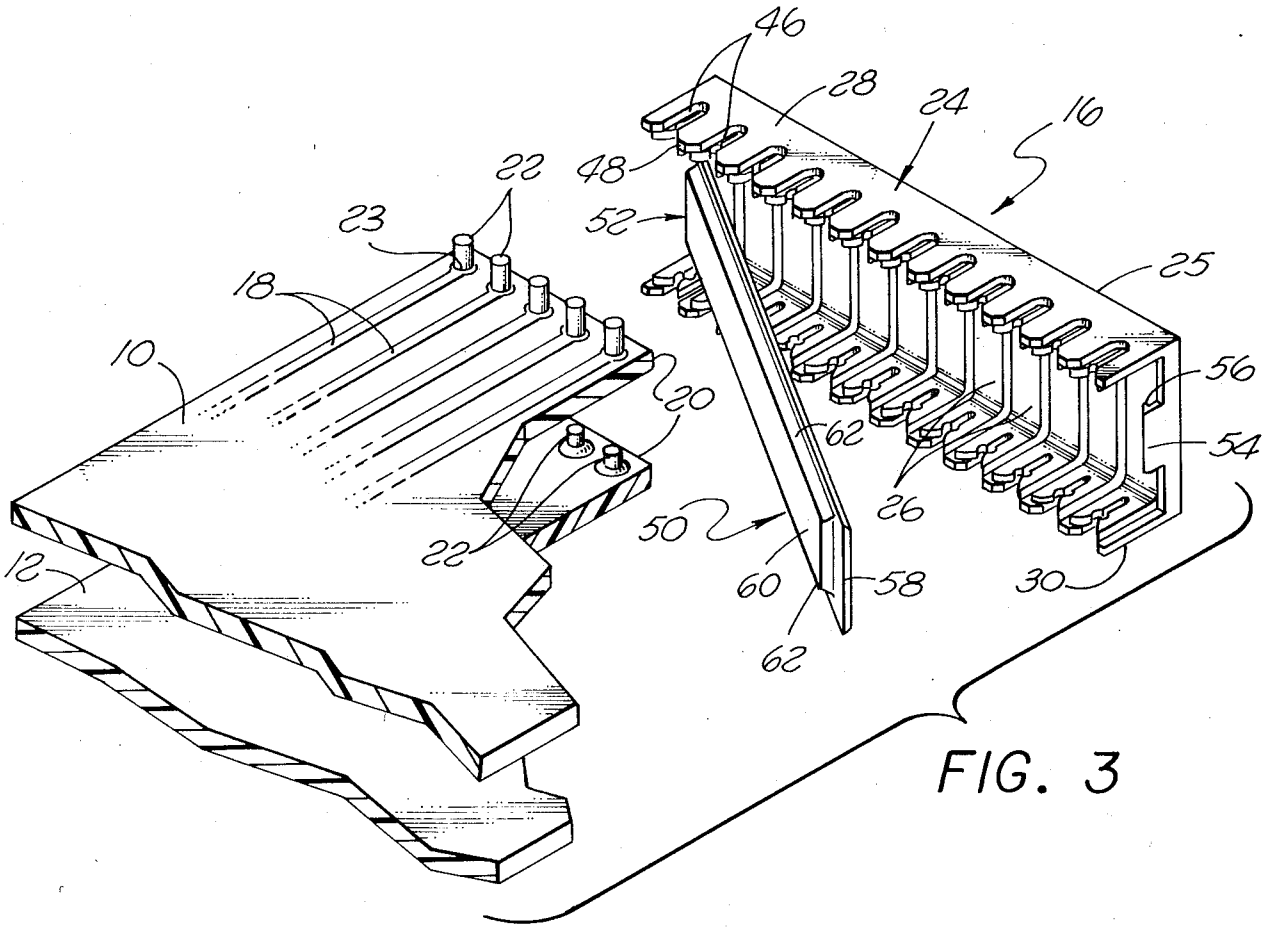
FIG. 3 is an enlarged, exploded, perspective view showing one end of the assembly illustrated in FIG. 1, with the connector being shown separate from the printed circuit board, and the contact retainer strip of the connector shown in an open position.

Referring now to FIGS. 1 and 2 of the drawings in detail, there is illustrated two printed circuit boards 10 and 12 which are spaced apart by a plurality of spacer pins 14. Stacking connectors of the present invention, generally designated 16, are mounted on the ends of the printed circuit boards. Typically the boards are substantially longer than they are wide. Conductive traces 18 are provided on the upper surface of the upper board 10. The traces extend to adjacent the end edge 20 of the board. Corresponding traces are formed on the bottom of the lower board 12. The traces on the two boards are generally vertically aligned with each other adjacent to the end edges 20 of the boards.

According to one feature of the present invention, a row of conductive pins 22 is mounted on each of the boards 10 and 12 adjacent to the edges 20 of the boards. The rows of pins 22 in the two boards are parallel to each other, and each pin in the upper board 10 generally vertically aligned with a corresponding pin in the lower board 12 thereby providing pairs of pins which are interconnected by the contacts in the connector 16. Preferably the pins are connected to the traces 18 on the boards by press-fitting the pins into plated-through holes 23 connected to the traces, and soldering the pins in the holes with other electronic components (not shown) mounted on the boards during a reflow soldering operation, so that no secondary operation is required to electrically connect the pins to the conductive traces on the boards. It is noted that the pins 22 in the upper board 10 extend upwardly from the upper surface of the board, while the pins 22 in the lower board 12 extend downwardly from the lower surface of the board.

The connectors 16 on the opposite ends of the printed circuit board assembly are identical. Each connector comprises a one piece, molded insulative housing 24 and a plurality of identical contacts 26. The housing 24 comprises an elongated member 25 of generally U-shaped cross-section comprising upper and lower flanges 28 and 30, respectively, interconnected by a vertically extending intermediate portion 32. The flanges extend generally perpendicular to the intermediate portion 32 of the housing.

As best seen in FIG. 4, each contact 26 is a double ended tuning fork contact. The contact has a central, vertically extending portion 34 and two end portions 36 which are bent in the same direction perpendicular to the central portion 34 of the contact. The end portions of the contacts are formed as tuning fork elements, comprising spaced, resilient contact beams 38 defining therebetween a slot 40. Aligned detent notches or recesses 42 are formed in the facing edges 44 of the beams 38. Each pair of recesses provides a circular opening which receives a cylindrical pin 22 on the printed circuit board to provide a detent latch or lock between the contact and the pin. The distance across the aligned recesses 42 is slightly less than the diameter of the pins so that there is resilient engagement between the contact beams 38 and the pin.

The contacts 26 are mounted in the U-shaped elongated member of the housing 24 of the connector spaced apart a distance corresponding to the spacing of the pins 22 on the printed circuit boards. When the contacts are mounted in the member 25, the central portion 34 of each contact bears against the inside surface of the intermediate portion 32 of the member, and the bent end portions 36 of the contact are in close proximity to the upper and lower flanges 28 and 30. Slots 46 are formed in the flanges 28 and 30. The slots extend to the outer edqes 48 of the flanges. The width of each slot 46 is slightly greater than the width of each slot 40 in the tuning fork end portions of the contacts 26 and greater than the diameters of pins 22 on the printed circuit boards.

Preferably the contacts 26 are held firmly in the U-shaped elongated member 25 of the housing 24 by an integral contact retainer 50, which is an elongated strip joined at one end of the member 25 by a live hinge 52. The opposite end of the elongated member 25 is formed with a resilient latch arm 54 embodying a latch shoulder 56 on its inner surface. The contact retainer 50 may be pivoted about the hinge 52 into the interior of the U-shaped elongated housing member 25 until the end 58 of the retainer engages behind the latch shoulder 56.

Preferably the contacts are stamped out of a flat sheet of metal, with the ends of the contacts joined by carrier strips (not shown). Thereafter the contacts with the carrier strips secured thereto are placed in a forming die to produce the bent tuning fork end portions 36. While the contacts are still joined to the carrier strips, and the contact retainer 50 is pivoted to an open position, the contacts are mounted in the U-shaped elongated housing member 25 with the slots 40 aligned with the slots 46 in the flanges of the housing member. Thereafter the contact retainer strip 50 is pivoted to a closed position as seen in FIG. 1 so that the end 58 engages behind the latch shoulder 56 to secure the contacts in position in the housing. Thereafter the carrier strips are removed from the end portions of the contacts. Thus, the connector of the present invention utilizes a one-piece molded housing and a plurality of identical contacts. The contacts may be inexpensively formed and easily mounted in the housing utilizing automated assembly techniques.

To mount the connector 16 on the printed circuit boards 10 and 12, the connector is positioned adjacent to the end edges 20 of the boards generally as shown in FIG. 3 (but with the retainer 50 closed), with the tuning fork end portions of the contacts generally aligned with the pins 22 on the boards. The distance between the end portions 36 of the contacts is slightly greater than the distance between the upper and lower surfaces of the boards 10 and 12 so that the contacts will have a generally sliding engagement over the boards when the connector is slid over the edges of the boards. As the connector is pushed over the edges of the boards, the pins 22 on the upper and lower boards will engage in the slots 40 in the tuning fork end portions 36 of the contacts providing an electrical connection between the contacts in the connector and the corresponding traces on the boards connected to the pins 22. As the connector is pushed over the edges of the boards, the contact beams 38, being somewhat resilient, expand outwardly until the pins engage the aligned recesses 42 on the facing edges of the beams, whereupon the beams will spring inwardly toward each other thereby providing a latching or detent lock between the contacts and the pins on the boards. Thus the contacts 26 and pins 22 on the printed circuit boards produce the double function of providing an electrical connection between the contacts and the traces on the boards, and a mechanical connection or locking of the connector 16 onto the boards, thereby avoiding the need for having any additional alignment or locking hardware between the connector and the boards as required in prior art stacking connectors.

Preferably the outer surface of the retainer strip 50 is formed with an upstanding guide ridge 60 which extends lengthwise of the strip, and has a width slightly less than the space between the printed circuit boards 10 and 12. Preferably the elongated sides 62 of the ridge 60 are tapered to facilitate guiding of the connector 16 onto the boards. The guide ridge 60 also serves to keep the circuit boards horizontally aligned at their ends which are remote from the spacer pins 14.

From the foregoing, it is seen that the present invention provides a relatively simple and inexpensive interconnection arrangement for the traces on a pair of spaced printed circuit boards wherein the contacts of the connector and the pins 22 on the boards provide both electrical connections between corresponding traces on the boards and a mechanical interlock between the connector and the boards. While it is preferable that the contacts 26 be mounted in an insulative housing 24, it will also be appreciated that the contacts could be used without a housing to provide electrical connection between a pair of spaced vertically extending conductive pins. Further, while the invention has been described in connection with a stacking connector for interconnecting traces on a pair of vertically spaced printed circuit boards, the connector could also be used for interconnecting conductive pins on other insulative members, if desired. Also, the printed circuit boards could be mounted in the same plane, in which case the contacts could be flat, or the boards could be mounted in side-by-side relationship with one board above the other, in which case the central portions of the contacts would extend at an angle relative to their tuning fork end portions.

Although several embodiments of the invention have been disclosed herein for purposes of illustration, it will be understood that various changes can be made in the form, details, arrangement and proportions of the various parts in such embodiments without departing from the spirit and scope of the invention as defined by the appended claims.

What is claimed is:

1. An electrical connector for making electrical connection between corresponding conductive pins of two spaced parallel rows of said pins mounted on insulative support means, comprising:

an elongated insulative member;

a plurality of spaced contacts mounted on said member;

each said contact having a central portion and two end portions;

each said end portion being a tuning fork element comprising two spaced contact beams defining a slot therebetween for receiving one of said pins therein, said beams having facing edges; and a recess in at least one of said edges of each said tuning fork element of each said contact for receiving said pin to provide a detent lock between the pin and said contact as well as electrical connection therebetween.

2. An electrical connector as set forth in claim 1 wherein:

a recess is formed in each of said edges of said tuning fork element, the recesses in the facing edges of each said element being generally opposite to each other.

3. The electrical connector of claim 1 in combination with a pair of vertically spaced insulative boards each having a row of conductive pins thereon adjacent to side edges of said boards, said rows being parallel to each other with the pins in one row being generally vertically aligned with corresponding pins in the other row to provide a plurality of pairs of pins, each said contact having its tuning fork elements engaged with one of said pair of pins with said pins positioned in the corresponding recesses thereof.

4. An electrical connector as set forth in claim 1 wherein:

said end portions of said contacts are bent in the same direction from said central portion.

5. An electrical connector as set forth in claim 4 wherein:

said end portions of each said contact are parallel to each other and substantially perpendicular to the central portion of said contact.

6. An electrical connector as set forth in claim 4 wherein:

said insulative member has a generally U-shaped cross-section providing an intermediate portion and upper and lower flanges; and said contacts are mounted within said insulative member with said end portions adjacent to said flanges and said central portions adjacent to said intermediate portion.

7. An electrical connector as set forth in claim 6 wherein:

said flanges have outer edges;

a plurality of spaced slots are formed in said flanges and open at said outer edges thereof; and each said flange slot is aligned with and is wider than said slot in a corresponding one of said tuning fork elements.

8. An electrical connector as set forth in claim 6 including:

contact retaining means for holding said central portions of said contacts against said intermediate portion of said insulative member.

9. An electrical connector as set forth in claim 8 wherein:

said retaining means comprises an elongated strip extending lengthwise of said insulative member between said bent end portions of said contacts.

10. An electrical connector as set forth in claim 9 wherein:

one end of said strip is pivotally connected to one end of said intermediate portion of said insulative member; and latch means releasably connects the opposite end of said strip to the opposite end of said intermediate portion.

11. An electrical connector as set forth in claim 9 wherein:

an elongated guide ridge is provided on the side of said strip opposite to said contacts for guiding said connector onto said insulative support means.

12. An electrical contact for making connection to a pair of vertically spaced, aligned conductive pins comprising:

a conductive strip having a central portion and two end portions bent in the same direction from said central portion;

each said end portion being a tuning fork element comprising two spaced contact beams defining a slot therebetween for receiving one of said pins therein, said beams having facing edges; and a recess in at least one of said edges of each said tuning fork element for receiving said pin to provide a detent lock between the pin and said contact as well as electrical connection therebetween.

13. An electrical contact for making connection to a pair of conductive pins comprising:

a double-end tuning fork contact element; and said element embodying detent means for making a latching connection directly to said pins.

14. A connection assembly comprising:

a pair of insulative boards;

a row of vertically extending conductive pins mounted on each of said boards;

said rows of pins being generally parallel to each other with each pin in one row being generally aligned with a corresponding pin in the other row to provide a plurality of pairs of pins;

electrical connector means for making electrical and mechanical connection between said pairs of pins; and said electrical connector means comprising a plurality of spaced contacts each having two tuning fork portions connected by a central portion, said tuning fork portions of each said contact being engaged with the pins of each said pair of pins.

15. A connection assembly as set forth in claim 14 wherein:

each said tuning fork portion comprises two spaced contact beams defining a slot therebetween receiving one of said pins therein, said beams having facing edges; and a recess is formed in at least one of said edges of each said tuning fork portion of each said contact receiving one of said pins to provide a detent lock between the pin and said contact.

16. A connection assembly as set forth in claim 14 wherein:

each said tuning fork portion of each said contact embodies detent recess means for locking said contact to said pair of pins.

17. A connection assembly as set forth in claim 16 wherein:

said connector means includes an insulative member carrying said contacts; and said tuning fork portions of said contacts constitute essentially the sole means for mounting said connector means on said boards.

18. A connection assembly as set forth in claim 14 wherein:

said boards are vertically spaced and have adjacent edges;

said rows of pins are mounted on said boards adjacent to said edges; and said electrical connector means is mounted over said edges.

19. A connection assembly as set forth in claim 18 wherein:

said central portion of each said contact extends vertically; and said tuning fork portions are contact end portions bent in the same direction generally perpendicular to said central portion, the distance between said end portions being slightly greater than the distance between the top surface and lower surface, respectively, of said boards.

20. A connection assembly as set forth in claim 18 wherein:

said tuning fork portions of each said contact are generally perpendicular to said central portion;

said connector means includes an insulative member on which said contacts are mounted;

said insulative member having a generally U-shaped cross-section providing an intermediate portion and upper and lower flanges; and said contacts are mounted within said insulative member with said end portions adjacent to said flanges and said central portions adjacent to said intermediate portion.

21. A connection assembly as set forth in claim 20 wherein:

said flanges have outer edges;

a plurality of spaced slots are formed in said flanges and open at said outer edges thereof; and each said flange slot is aligned with and is wider than said slot in a corresponding one of said tuning fork portions.

22. A connection assembly as set forth in claim 21 including:

contact retaining means for holding said central portions of said contacts against said intermediate portion of said insulative member, said retaining means comprising an elongated strip extending lengthwise of said insulative member between said end portions of said contacts.

23. A connection assembly as set forth in claim 22 wherein:

one end of said strip is pivotally connected by an integral live hinge to on end of said intermediate portion of said insulative member; and latch means releasably connects the opposite end of said strip to the opposite end of said intermediate portion.

24. A connection assembly as set forth in claim 22 wherein:

an elongated guide ridge is provided on the side of said strip opposite to said contacts, said guide ridge extending between said boards.

* * * * *